US007016515B2

(12) United States Patent
Ohashi

(10) Patent No.: US 7,016,515 B2
(45) Date of Patent: Mar. 21, 2006

(54) SPEAKER APPARATUS

(75) Inventor: Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/789,006

(22) Filed: Feb. 27, 2004

(65) Prior Publication Data

US 2004/0184622 A1 Sep. 23, 2004

Related U.S. Application Data

(62) Division of application No. 09/445,044, filed as application No. PCT/JP99/01750 on Apr. 4, 1999, now Pat. No. 6,904,158.

(30) Foreign Application Priority Data

Apr. 3, 1998 (JP) ..... 10-091565
Apr. 8, 1998 (JP) ..... 10-095809

(51) Int. Cl.
*H04R 25/00* (2006.01)

(52) U.S. Cl. ..... 381/406; 381/400; 381/412; 381/409

(58) Field of Classification Search ..... 381/396, 381/400, 401, 402, 403, 406, 412, 409, 410, 381/417

See application file for complete search history.

(56) References Cited

U.S. PATENT DOCUMENTS 4,300,022 A * 11/1981 Hastings-James et al. .. 381/121

FOREIGN PATENT DOCUMENTS

JP 06292296 A * 10/1994

* cited by examiner

*Primary Examiner*—Huyen Le
*Assistant Examiner*—Tuan Duc Nguyen
(74) *Attorney, Agent, or Firm*—Jay H. Maioli

(57) ABSTRACT

In an electromagnetic induction type speaker apparatus, individual constants are set in such a manner that the following formula is satisfied $$N\times(R1\times R2)^{1/2}/(2\pi\times L1\times(1-k2)^{1/2}>2000$$

where R1 is the DC resistance of a primary coil; L1 is the inductance of the primary coil; N is the number of turns of the primary coil; R2 is the DC resistance of the secondary coil; L2 is the inductance of the secondary coil; and k is the coupling coefficient of the primary coil and the secondary coil. In addition, the constants L1 and l2 are selected in such a manner that the ratio of the inductance L1 and the inductance L2 becomes equal to the ratio of the DC resistance R1 and the DC resistance R2.

2 Claims, 4 Drawing Sheets

CALCULATION EXAMPLE OF FREQUENCY CHARACTERISTIC OF DRIVING FORCE OF ELECTROMAGNETIC INDUCTION SPEAKER

SPEAKER APPARATUS

This is a division of prior application Ser. No. 09/445,044 filed Dec. 1, 1999, now U.S. Pat. No. 6,904,158 which is a 371 of PCT Application No. PCT/JP99/01750 filed Apr. 4, 1999.

TECHNICAL FIELD

The present invention relates to a speaker apparatus for use with various audio units and video units.

RELATED ART

A conventional speaker apparatus is structured as shown in FIG. 6. Such a speaker apparatus is referred to as dynamic speaker. The speaker apparatus has a magnetic circuit that comprises a doughnut shaped magnet 1, a first magnetic yoke 2, a second magnetic yoke 3, and a gap 4. The first and second magnetic yokes 2 and 3 are composed of a magnetic material such as steel. The first magnetic yoke 2 is composed of a cylindrical pole piece 2*a* and a disc shaped flange portion 2*b*. The disc shaped flange portion 2*b* is perpendicular to the center pole portion 2*a*. The second magnetic yoke 3 is referred to as plate. The second magnetic yoke 3 is doughnut shaped in such a manner that the inner diameter of the second magnetic yoke 3 is larger than the outer peripheral diameter of the pole piece 2*a* by the gap 4.

The magnet 1 is adhered to the front surface of the flange portion 2*b* of the first magnetic yoke 2 and the plate 3 in such a manner that the pole piece 2*a* is inserted into an inner peripheral hollow portion of the magnetic 1 and an inner peripheral hollow portion of the plate 3. A voice coil 6 is disposed around a voice coil bobbin 5 and in the gap 4 formed between the plate 3 and the pole piece 2*a*. The voice coil bobbin 5 is composed of a non-conductor. An acoustic vibrating plate 7 is adhered to the voice coil bobbin 5. The acoustic vibrating plate 7 is for example a paper cone. An edge portion of the acoustic vibrating plate 7 is fixedly to a speaker frame 8. A signal input line (lead line) 9 is connected to the voice coil 6.

In the speaker apparatus shown in FIG. 6, when a current I corresponding to an acoustic signal flows in the voice coil 6, an interaction of the current I and a magnetic flux B of the magnetic gap 4 causes driving force F that vibrates the acoustic vibrating plate 7 to take place. The driving force F can be expressed by formula (1).

$$F=B\times I\times D \tag{1}$$

where D is the length of the voice coil 6 in the magnetic field.

Since the dynamic speaker apparatus has a signal input line in the vibrating system, the signal input line adversely affects the vibrating balance of the acoustic vibrating system. In addition, the signal current that flows in the voice coil 6 causes it to heat. Thus, it is necessary to consider the damage of the bobbin due to the heat generated by the voice coil 6. Consequently, the amount of the signal current that flows in the voice coil 6 is restricted.

In addition, an electromagnetic induction type speaker apparatus is also known. In the electromagnetic induction type speaker apparatus, an exciting primary coil is disposed around a pole piece. A secondary coil composed of a conductive one-turn ring is disposed in a gap of a magnetic circuit. When a signal current flows in the primary coil, a current is induced in the secondary coil. When the induced current cuts a magnetic flux in the gap, driving force that drives an acoustic vibrating plate connected to the secondary coil is generated.

In the electromagnetic induction type speaker apparatus, since the exciting primary coil to which the signal current is supplied is disposed around the pole piece that has high heat conductivity, the primary coil can easily radiate heat. Thus, a relatively large amount of signal current can be supplied to the primary coil. In addition, since the vibrating system does not have a signal input line, the vibrating balance of the acoustic vibrating system is good.

However, recently, as recording technologies and recording mediums have advanced, it has become clear that an acoustic component that exceeds the audible frequency band of ears of humans (20 kHz or higher) affects a reproduction acoustic output corresponding to auditory sense. Thus, a microphone with a wide frequency band of 100 kHz or higher as a sound pickup characteristic is known.

Thus, a speaker apparatus that properly reproduces an acoustic component that exceeds the audible frequency band (20 kHz or higher) has been desired.

In the case of the conventional typical speaker apparatus as shown in FIG. 6, since the voice coil 6 has a DC resistance R1 and an inductance component L1, when the frequency exceeds the resonance frequency f0, the input impedance Zin of the speaker apparatus can be expressed by formula (2).

$$Zin=R1+j\cdot 2\cdot\pi\cdot L1 \tag{2}$$

From formula (2), it is clear that the input impedance Zin is proportional to the frequency f. Thus, as the frequency f becomes high, the current I that flows in the voice coil 6 decreases. In the speaker apparatus shown in FIG. 6, the driving force F becomes weak. Thus, the speaker apparatus shown in FIG. 6 is not suitable for reproducing an acoustic component that exceeds the audible frequency band of 20 kHz or higher.

The electromagnetic induction type speaker apparatus has the above-described features. However, the amount of the induction current that flows in the secondary coil composed of a one-turn conductive ring varies corresponding to the constants of the primary coil and the secondary coil. Depending on selected values of the constants of the primary coil and the secondary coil, even if the amount of the signal current that flows in the primary voice coil is large, a desired amount of current as an induced current does not flow. Thus, the efficiency of the electromagnetic inductive type speaker apparatus becomes low.

DISCLOSURE OF THE INVENTION

The present invention is made from the above-described point of view. An object of the present invention is to allow an acoustic component of 20 kHz or higher to be properly reproduced.

Another object of the present invention is to allow a current to be effectively induced in a secondary coil of an electromagnetic induction type speaker apparatus.

A speaker apparatus of claim 1 comprises a primary coil disposed in the vicinity of a gap of a magnetic circuit and to which a current corresponding to an input audio signal is supplied, a secondary coil, disposed in the gap, for inducing a current corresponding to a current that flows in the primary coil, and a vibrating plate vibrated by the secondary coil with an interaction of the current induced by the secondary coil and a magnetic flux in the gap, wherein the following formula is satisfied $$N\times(R1\times R2)^{1/2}/\{2\pi\times L1\times(1-k2)^{1/2}\}\geqq 20000 \quad (3)$$

where R1 is the DC resistance of the primary coil, L1 is the inductance of the primary coil, N is the number of turns of the primary coil, R2 is the DC resistance of the secondary coil, and k is the coupling coefficient of the primary coil and the secondary coil.

A speaker apparatus of claim 2 is the speaker apparatus of claim 1, wherein the individual constants R1, L1, N, R2, and k satisfy formula (4) at a frequency f in a desired reproduction frequency band $$2\pi\times f\times L1^2\times(N^2\times R2+L1\times R1)/(N^2\times X^{1/2})\geqq 0.3$$

$$X=(2\pi\times f)^2\times(L1\times R1+L1\times R1/N^2)^2+\{-R1\times R2+(2\pi\times f)^2\times L1^2\times(1-k^2)/N^2\}^2 \quad (4)$$

A speaker apparatus of claim 3 comprises a primary coil disposed in the vicinity of a gap of a magnetic circuit and to which a current corresponding to an input audio signal is supplied, a secondary coil, disposed in the gap, for inducing a current corresponding to a current that flows in the primary coil, and a vibrating plate vibrated by the secondary coil with an interaction of the current induced by the secondary coil and a magnetic flux in the gap, wherein the following relation is satisfied $$L1/L2=R1/R2$$

where R1 is the DC resistance of the primary coil, L1 is the inductance of the primary coil, R2 is the DC resistance of the secondary coil, and L2 is the inductance of the secondary coil.

According to claim 1 of the present invention, as a driving method for a acoustic vibrating plate, an electromagnetic inducting method is used. The values of the individual constants are determined in such a manner that formula (3) is satisfied. Thus, since the inductance component of the input impedance becomes low and thereby allows a predetermined amount of a current to flow, predetermined driving force can be obtained in a high frequency band of 20 kHz or higher.

According to claim 2 of the present invention, since the values of the individual constants are determined in such a manner that formula (4) is satisfied, the amount of an induced current at a desired reproduction frequency f can be limited to −10 dB or less of the maximum current. Thus, desired driving force can be obtained in the high frequency band of 20 kHz or higher.

According to claim 3 of the present invention, since the constants of the primary coil and the secondary coil are selected, the induced current that flows in the secondary coil becomes maximum. Thus, an electromagnetic induction type speaker with high efficiency can be accomplished.

BEST MODES FOR CARRYING OUT THE INVENTION

Next, with reference to the accompanying drawings, a speaker apparatus according to a first mode of the present invention will be described. According to the present invention, an acoustic vibrating plate is driven by the electromagnetic inducing method.

Figure 1:
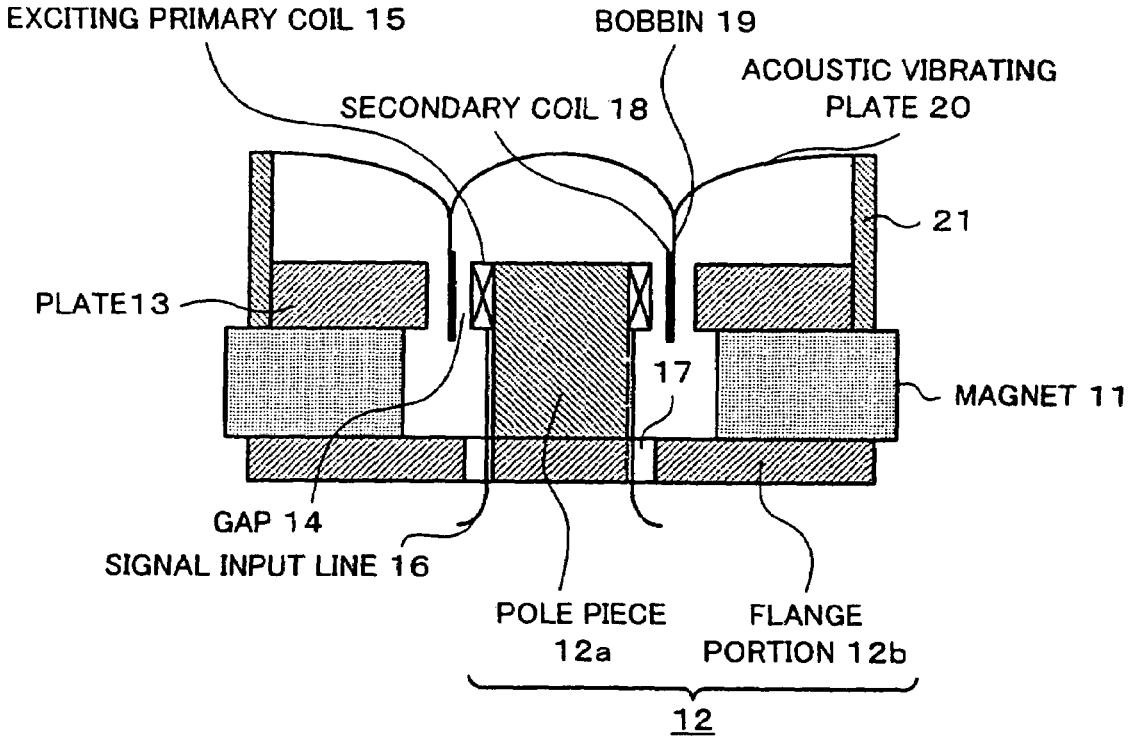
FIG. 1 is a sectional view showing an example of the structure of a speaker apparatus according to a first mode of the present invention.
Figure 6:
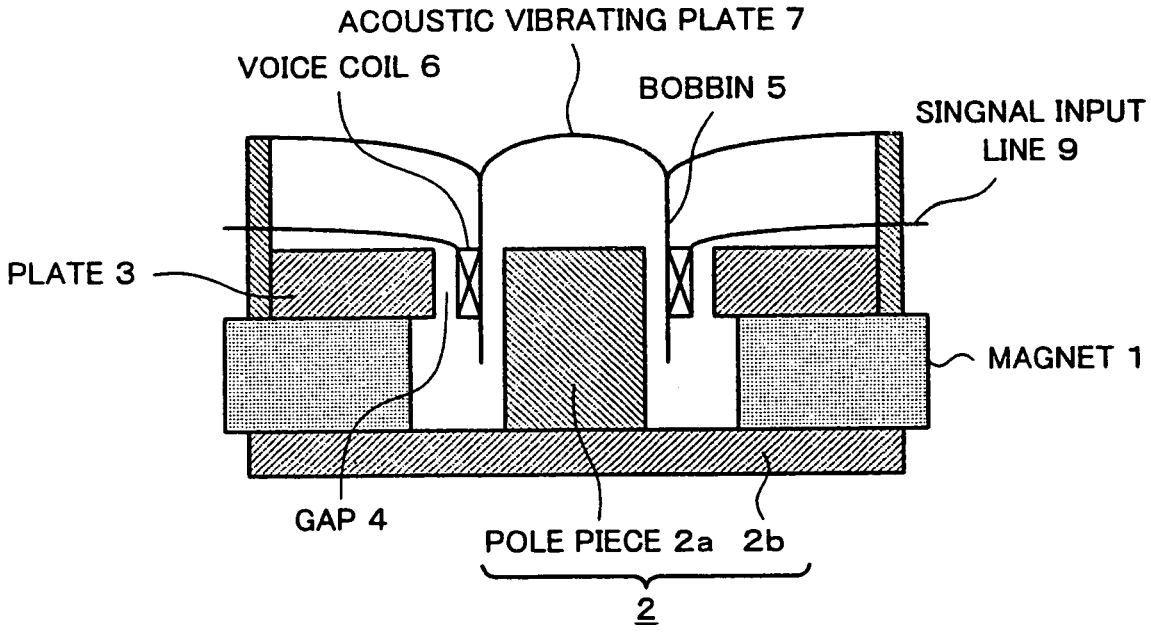
FIG. 6 is a sectional view showing an example of the structure of a conventional dynamic speaker apparatus.

FIG. 1 shows the structure of an electromagnetic induction type speaker apparatus according to the first mode of the present invention. In the speaker apparatus shown in FIG. 1, the structure of a magnetic circuit is the same as that of the speaker apparatus shown in FIG. 6. In other words, the magnetic circuit of the speaker apparatus shown in FIG. 1 is composed of a first yoke 12, a doughnut shaped plate 13, a doughnut shaped magnet 11, and a gap 14. The first yoke 12 has a cylindrical pole piece 12*a* and a disc shaped flange portion 12*b*. The doughnut shaped plate 13 composes a second yoke. The doughnut shaped magnet 11 is disposed between the flange portion 12*b* of the first yoke 12 and the plate 13. The gap 14 is formed between the plate 13 and the pole piece 12*a*.

A driving coil as an exciting primary coil is disposed at an outer peripheral portion of the pole piece 12*a* facing the gap 14 or/and at an inner peripheral portion of the plate 13. According to the first mode of the present invention, an exciting primary coil 15 is disposed at an outer peripheral portion of the pole piece 12*a*. To disposed the primary coil 15, a small diameter portion with the length of the windings of the primary coil 15 may be formed in the vicinity of the vertex portion of the pole piece 12*a*.

A signal input line (lead line) 16 is connected from the primary coil 15 to the rear side of the flange portion 12*b* through a through-hole 17 formed in the flange portion 12*b* of the first magnetic yoke 12.

According to the first mode of the present invention, a secondary coil 18 is inserted in the gap 14. The secondary coil 18 is composed of a short coil that electromagnetically couples with the primary coil 15. In this example, the secondary coil 18 is a one-turn short coil composed of a non-magnetic and conductive material such as a cylindrical ring of aluminum. The conductive one-turn ring composed of aluminum of the secondary coil 18 is adhered to the bobbin 19. The bobbin 19 is composed of a non-magnetic and non-conductive material such as a card board.

The width of the secondary coil 18 (equivalent to the height of the one-turn ring) is longer than the length in the vibrating direction of the gap 14 by the length of the amplitude of the vibration of the secondary coil 18. However, the width of the secondary coil 18 should be as small as possible.

The acoustic vibrating plate 20 (for example, a paper cone) is disposed to the bobbin 19. The acoustic vibrating plate 20 is disposed to a speaker frame 21 through a flexible edge (not shown).

In the electromagnetic induction type speaker apparatus, when a signal current is supplied to the exciting primary coil 15, an induced current flows in the one-turn ring as the secondary coil 18 disposed opposite to the primary coil. The induced current I that flows in the secondary coil 18 and the magnetic flux density B in the gap 14 cause driving force F that drives the secondary coil 18 in the direction of the height of the ring to take place. Thus, the acoustic vibrating plate 20 is vibrated corresponding to the signal current.

In this case, the driving force F can be expressed by formula (5)

$$F=B\times I\times L \tag{5}$$

where L is the length of the one-turn ring as the secondary coil 18 (namely, the circumference of the ring).

According to the first mode of the present invention, the individual constants of the primary coil 15 and the secondary coil 18 are selected in such a manner that following formula (6) is satisfied.

$$N\times(R1\times R2)^{1/2}/(2\pi\times L1\times(1-k^2)^{1/2})\geqq 20000 \tag{6}$$

where R1 is the DC resistance of the primary coil 15; L1 is the inductance of the primary coil 15; N is the number of turns of the primary coil 15; R2 is the DC resistance of the secondary coil 18; k is the coupling coefficient of the primary coil 15 and the secondary coil 18.

In addition, the constants R1, L1, R2, and k are selected in such a manner that formula (7) is satisfied.

$$2\pi\times f\times L1^2\times(N^2\times R2+L1\times R1)/(N^2\times X^{1/2})\geqq 0.3$$

$$X=(2\pi\times f)^2\times(L1\times R1+L1\times R1/N^2)^2+\{-R1\times R2+(2\pi\times f)^2\times L1^2\times(1-k^2)/N^2\}^2 \tag{7}$$

Since the individual constants R1, L1, R2, and k are selected in such a manner, in a high frequency band of 20 kHz or higher, a constant current can be supplied. Thus, desired driving force can be obtained. In particular, when the individual constants R1, L1, R2, and k are set in such a manner that formula (7) is satisfied, the decrease of the induced current at a desired high frequency can be suppressed within 10 dB against the maximum induced current as will be described next.

Figure 2:
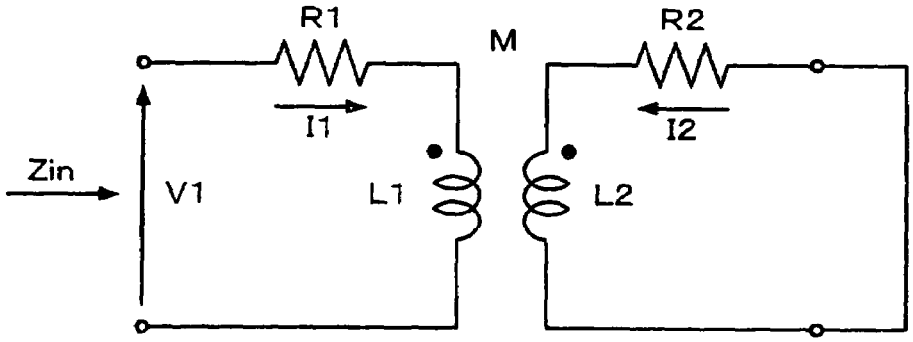
FIG. 2 is a schematic diagram showing an electric equivalent circuit of an electromagnetic induction portion of the speaker apparatus according to the first mode of the present invention.

The electric equivalent circuit of the electromagnetic induction portion of the electromagnetic induction type speaker apparatus is shown in FIG. 2. In FIG. 2, R1 and L1 are the DC resistance and the inductance of the exciting primary coil 15, respectively; R2 and L2 are the DC resistance and the inductance of the secondary coil 18, respectively; M is the mutual inductance; and Zin is the input impedance of the speaker apparatus.

According to the equivalent circuit shown in FIG. 2, the input impedance Zin of the speaker apparatus can be expressed by formula (8).

$$Zin=(R1+A^2+R2)+j\omega(L1-A^2\times L2).$$

$$A^2=\omega^2\times M^2/(\omega^2\times L2^2=R2^2)$$

$$M^2=k^2\times L1\times L2 \tag{8}$$

where ω is the angular frequency.

When the frequency f is high, the following relation is satisfied.

$$A^2=M^2/L2^2=k^2\times L1/L2$$

Thus, formula (8) can be expressed by formula (9).

$$Zin=(R1+k^2\times R2\times L1/L2)+j\omega L1(1-k^2) \tag{9}$$

In addition, when only the exciting primary coil 15 is used, the input impedance Zin can be expressed by formula (10).

$$Zin=R1+j\omega L1 \tag{10}$$

When formula (9) and formula (10) are compared, it is clear that when the secondary coil 18 is used in a high frequency band, the inductance component becomes small due to the coupling coefficient k. In particular, when the coupling coefficient k is 1, the inductance component in the high frequency band becomes very small. Thus, it is clear that the input impedance becomes constant against the frequency.

Since the inductance component of the input impedance Zin becomes small without need to decrease the inductance component of the exciting primary coil 15, a constant current flows in the secondary coil in a high frequency band of 20 kHz or higher. Thus, constant driving force can be obtained.

When the electromagnetic induction type speaker apparatus is driven at a constant voltage, the frequency characteristic of the induced current that flows in the one-turn ring as the secondary coil 18 can be expressed by formula (11).

$$I2/V1=\omega\cdot k(L1\times L2)^{1/2}/Y^{1/2}$$

$$Y=\omega^2\times(L1\times R2+L2\times R1)^2+\{-R1\times R2+\omega^2\times L1\times L2\times(1-k^2)\}^2 \tag{11}$$

From formula (11), the frequency f0 at which the induced current I2 becomes maximum is given by formula (12).

$$f0=N\times(R1\times R2)^{1/2}/\{2\pi\times L1\times(1-k^2)^{1/2}\} \tag{12}$$

When formula (6) is satisfied, the relation f0≧20000 is required. Thus, in a high frequency band of 20 kHz or higher, the induced current becomes maximum.

To satisfy formula (7), the decrease of the induced current at a desired frequency f in a high frequency band of 20 kHz or higher can be suppressed within 10 dB against the maximum current.

Next, a second mode of the present invention will be described. The structure of an electromagnetic induction type speaker apparatus according to the second mode is similar to that according to the first mode shown in FIG. 1. In the second mode, the individual constants are selected in such a manner that formula (13) is satisfied $$L1/L2=R1/R2 \tag{13}$$

where R1 is the DC resistance of the primary coil 15; L1 is the inductance of the primary coil 15; R2 is the DC resistance of the secondary coil 18; and L2 is the inductance of the secondary coil 18.

When the coupling coefficient k of the primary coil 15 and the secondary coil 18 is equal to 1, formula (13) can be expressed by formula (14).

$$N^2=R1/R2$$

$$L1/L2=N^2 \tag{14}$$

Since the individual constants L1, L2, R1, and R2 are selected in such a manner, the induced current of the secondary coil 18 as the driving force of the acoustic vibrating plate becomes maximum. Thus, an electromagnetic induction type speaker apparatus with high efficiency can be accomplished. The square of the number of turns of the primary coil is proportional to the ratio of the DC resistance R1 of the primary coil and the DC resistance R2 of the secondary coil as will be described next.

The electric equivalent circuit of an electromagnetic induction portion of the electromagnetic induction type speaker apparatus according to the second mode is the same as that according to the first mode shown in FIG. 2. For simplicity, in the second mode, the description of similar portions to those of the electromagnetic induction portion of the first mode is omitted.

When the electromagnetic induction type speaker apparatus according to the second mode is driven at a constant voltage, the frequency characteristic of an induced current that flows in a one-turn ring as a secondary coil 18 can be expressed by formula (15).

$$I2/V1=\omega\cdot k(L1\times L2)^{1/2}/Y^{1/2}$$

$$Y=\omega^2\times(L1\times R2+L2\times R1)^2+\{-R1\times R2+\omega^2\times L1\times L2\times(1-k^2)\}^2 \quad (15)$$

where V1 is the driving voltage; I2 is the induced current of the secondary coil 18.

Because of formula (15), the maximum value I2/V1 (max) of the induced current I2 can be expressed by formula (16).

$$I2/V1(\max)=k\times(L1\times L2)^{1/2}/(L1\times R2+L2\times R1) \quad (16)$$

When formula (14) is satisfied, the right side of formula (16) becomes maximal. In other words, the induced current I2 becomes maximum.

As expressed by formula (13), when the ratio of the inductance L1 of the exciting primary coil 15 and the inductance L2 of the secondary one-turn conductive ring 18 is equal to the ratio of the DC resistance of the coil 15 and the DC resistance of the coil 18, it is clear that the induced current I2 of the secondary coil 18 becomes maximum.

When the coupling coefficient k is equal to 1, as expressed by formula (14), it is clear that when the square of the number N of turns of the exciting primary coil 15 is equal to the ratio of the DC resistance R1 of the exciting primary coil 15 and the DC resistance R2 of the secondary coil 18, the induced current I2 becomes maximum.

FIRST EMBODIMENT

Next, an exciting primary coil 15 and a secondary coil 18 of a speaker apparatus according to a first embodiment based on the first mode of the present invention will be described.

In the first embodiment, the sizes and characteristics of the exciting primary coil 15 and the one-turn ring as the secondary coil 18 are as follows:

Exciting primary coil 15:

Diameter=13 mm; winding width=2.6 mm; number of winding layers=2; total number of turns (N)=33; DC resistance (R1)=3.22 Ω; inductance (L1)= 34.5 μH Secondary coil 18 (one-turn ring):

Diameter (inner diameter)=13.36 mm; width=3.0 mm; thickness=0.2 mm; material=aluminum; DC resistance (R2) =0.00207 Ω; inductance (L2)=0.032 μH In this case, the inductance L2 is almost equal to $L1/N^2$.

Figure 3:
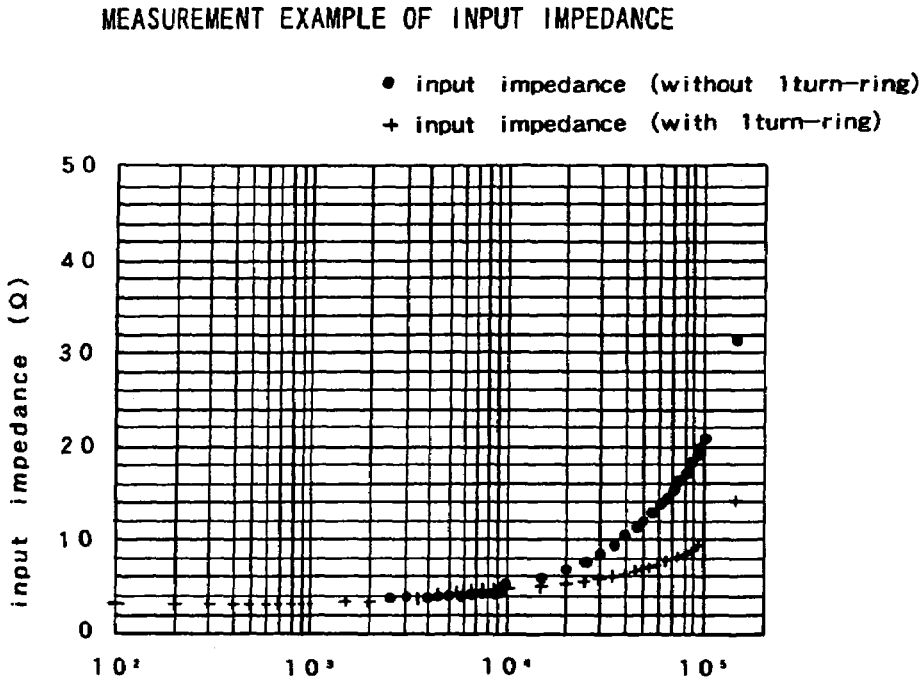
FIG. 3 is a graph showing a measurement example of input impedance of the speaker apparatus according to the first mode of the present invention.

FIG. 3 shows a measurement example of the frequency characteristic of input impedance of the speaker apparatus according to the first embodiment. In FIG. 3, "·" represents a measurement point of the frequency characteristic of input impedance in the case that the secondary coil 18 is not used, whereas "+" represents a measurement point of the frequency characteristic of input impedance in the case that the secondary coil 18 is used.

As is clear from the measurement values, the inductance component of the input impedance of the electromagnetic induction type speaker apparatus is remarkably small. When the above-mentioned values of the individual constants R1, L1, N, and R2 are substituted into the left side of formula (6) (same as formula (3)), the left side becomes 22907. Thus, formula (6) is satisfied. According to the measurement result, the coupling coefficient k is 0.84.

When the above-mentioned values of the individual constants R1, L1, N, R2, and k are substituted into the left side of formula (4), the left side becomes 0.67. Thus, the relation of formula (7) (same as formula (4)) is satisfied.

Figure 4:
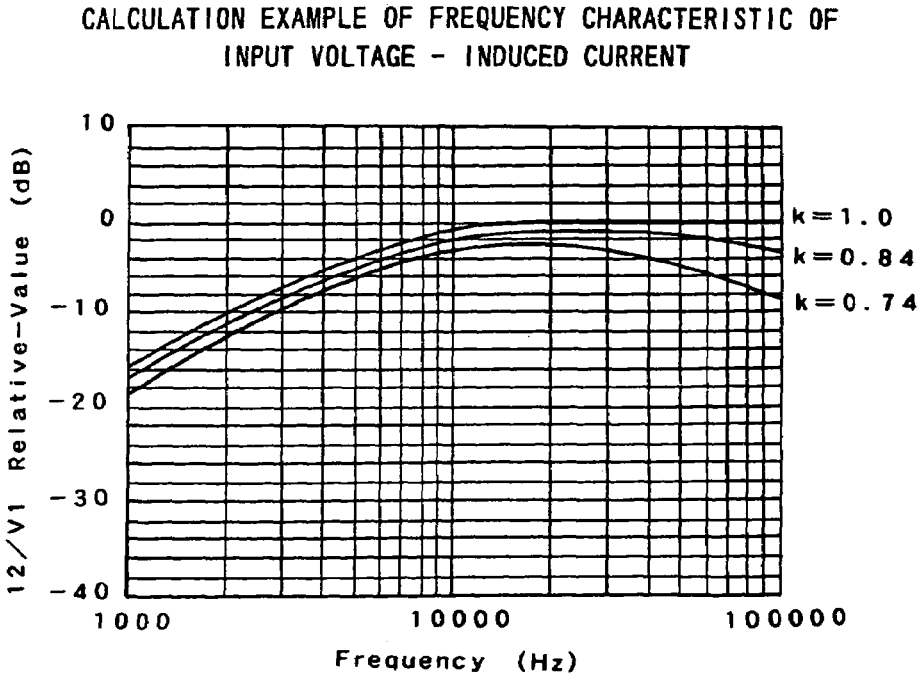
FIG. 4 is a graph showing a frequency characteristic of an induced current of the speaker apparatus according to the first mode of the present invention.

FIG. 4 shows a calculation example of the frequency characteristic of relative values of induced current using the above-mentioned values of the individual constants R1, L1, N, and R2 and formula (12). As described above, in the first embodiment of which the coupling coefficient k is 0.84, the decrease of the induced current at 100 kHz is 3.5 dB against a value at 20 kHz.

As another example, when the coupling coefficient k is 1.0, a constant driving current (induced current) flows in the secondary coil in a frequency band from 20 kHz to 100 kHz. When the coupling coefficient k is 0.74, the decrease of the induced current at 100 kHz is 6 dB against a value at 20 kHz.

When the values of the individual constants R1, L1, N, R2, and k are set in such a manner that formula (6) (same as formula (3)) and formula (7) (same as formula (4)) are satisfied. The decrease of the induced current at up to a desired high frequency of 20 kHz or higher can be suppressed within 10 dB.

SECOND EMBODIMENT

Next, an exciting primary coil 15 and a secondary coil 18 of a speaker apparatus according to a second embodiment based on the second mode of the present invention will be described.

In the second embodiment, the characteristics of the exciting primary coil 15 and the one-turn ring as the secondary coil 18 are as follows. The frequency characteristic of the driving force is calculated corresponding to the amount of the induced current. In this example, the inductance L2 of the secondary coil 18 that is a one-turn conductive ring is a parameter. The coupling coefficient k is 0.9. The driving voltage V1 is 4 V. The magnetic flux density of the magnetic circuit is 1.5 T. The length of the one-turn conductive ring is 0.042 m.

Exciting primary coil 15:

DC resistance (R1)=3.22 Ω

Inductance (L1)=34.5 μH

Secondary coil 18 (one-turn conductive ring):

DC resistance (R2)=0.00207 Ω

Inductance (L2)=parameter

Figure 5:
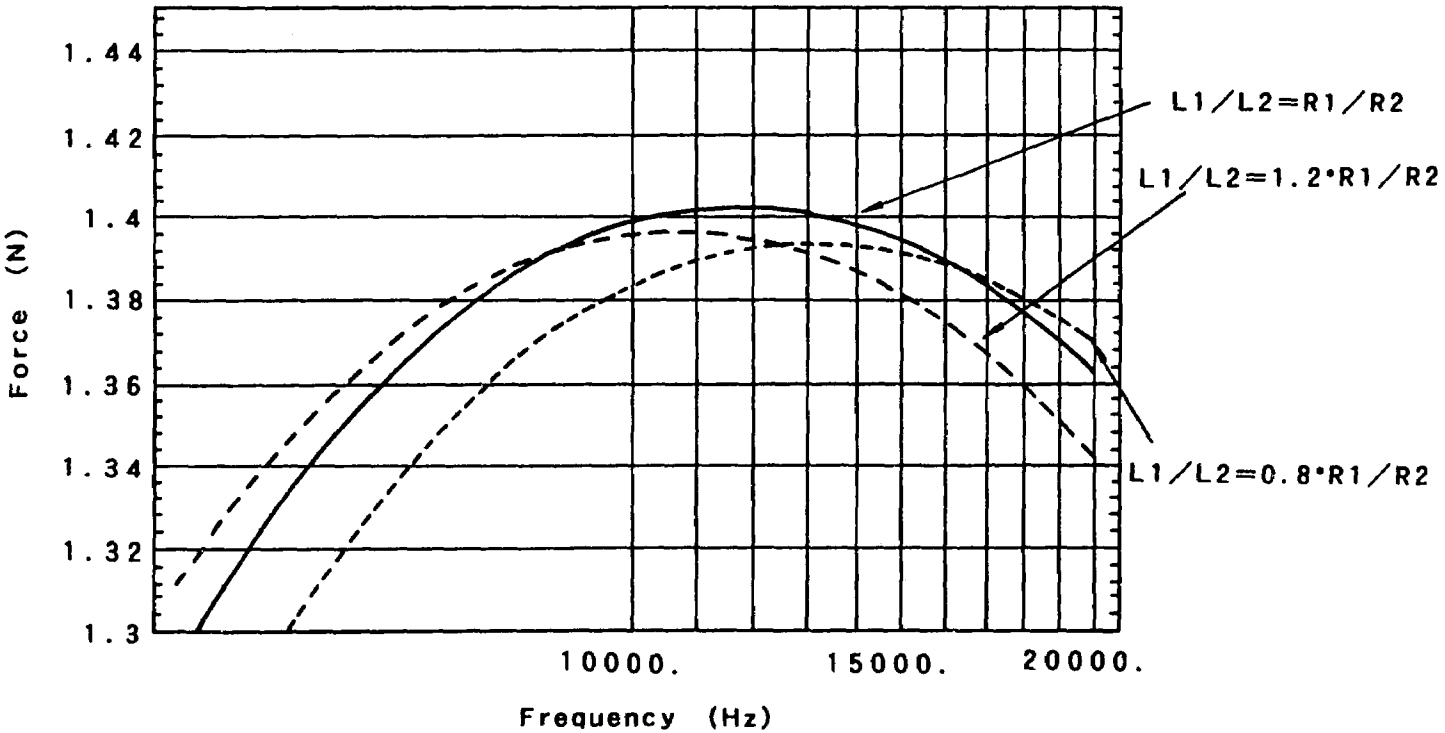
FIG. 5 is a graph showing a frequency characteristic of an induced current of a speaker apparatus according to a second mode of the present invention.

FIG. 5 shows the calculation result. Thus, from FIG. 5, it is clear that when the ratio of L1/L2 satisfies formula (13), the driving force becomes maximum. When the coupling coefficient k is 1, from formula (14), the number of turns N is set to 3.

In the second embodiment, constants are determined by varying the inductance L2 of the secondary coil 18 as a one-turn conductive ring. Alternatively, with a constant of the inductance L2 of the secondary coil 18, by varying the inductance L1 of the primary coil 15 as a parameter, constants can be determined in such a manner that formula (3) is satisfied.

INDUSTRIAL UTILIZATION

As described above, according to the present invention, even in a high frequency band of 20 kHz or higher, the decrease of a driving current (induced current) is very small. Thus, a speaker apparatus of which the decrease of the driving force is very small in a high frequency band of 20 kHz or higher can be accomplished.

In addition, according to the present invention, by optimizing the individual constants of the electromagnetic induction portion, the amount of the induced current can become maximum. Thus, an electromagnetic induction type speaker apparatus with high efficiency can be accomplished.

The invention claimed is:

1. A speaker apparatus, comprising:

a primary coil arranged on a fixed pole piece and disposed in a vicinity of a gap of a magnetic circuit and to which a current corresponding to an input audio signal is supplied;

a one-turn cylindrical ring forming a secondary coil, arranged on a movable bobbin and disposed in the gap for having induced therein a current corresponding to a current that flows in said primary coil, and being movable relative to said primary coil; and a vibrating plate attached said bobbin and vibrated by said secondary coil with an interaction of the current induced by said secondary coil and a magnetic flux in the gap, wherein the following relation is satisfied $$L1/L2=R1/R2$$

Wherein R1 is a DC resistance of said primary coil; L1 is an inductance of said primary coil; R2 is a DC resistance of said secondary coil; and L2 is an inductance of said secondary coil.

2. The speaker apparatus as set forth in claim 1, wherein when a coupling coefficient of said primary coil and said secondary coil is equal to 1, a square of the number of turns of said primary coil is equal to a ratio of the DC resistance R1 of said primary coil and the DC resistance R2 of said secondary coil.

* * * * *